United States Patent [19]

Simon

[11] 4,335,777

[45] Jun. 22, 1982

[54] MULTIPLE STRIPS DOORS

[75] Inventor: Alexandre M. V. Simon, Montceaux-les-Meaux, France

[73] Assignee: Societe Anonyme: "MAVIL", Antony, France

[21] Appl. No.: 101,984

[22] Filed: Dec. 10, 1979

[30] Foreign Application Priority Data

Dec. 18, 1978 [FR] France ..... 78 37067

[51] Int. Cl.[3] ..... A47H 1/00

[52] U.S. Cl. ..... 160/332; 24/201 HE; 248/339; 160/184

[58] Field of Search ..... 160/332, 184, 196 D, 160/200, 208; 24/201 HE, 201 A, 201 R, 201 LR, 45-47, 100.5; 312/184, 186; 402/73; 248/304, 306, 307, 322, 339

[56] References Cited

U.S. PATENT DOCUMENTS 2,150,118 3/1939 Harrison ..... 24/100.5
2,787,435 4/1957 Shields ..... 248/306 X
3,057,357 9/1962 Duncan ..... 402/77 X
4,033,396 7/1977 Thomasset ..... 160/184

FOREIGN PATENT DOCUMENTS 621910 6/1961 Canada ..... 24/201 LP
879163 6/1953 Fed. Rep. of Germany ..... 160/332
2389748 12/1978 France .

*Primary Examiner*—C. J. Husar
*Assistant Examiner*—Cherney S. Lieberman
*Attorney, Agent, or Firm*—Dowell & Dowell

[57] ABSTRACT

A door composed of multiple strip of the type comprising a support with hooks and strips provided with means for hooking to said support, wherein the support takes the form of a channel whose transverse section is in the form of an inverted C, in the base of which are arranged hooks known per se whose ends constitute a guide with the corresponding edge of the channel with a view to receiving a panel which closes the hooks.

1 Claim, 2 Drawing Figures

MULTIPLE STRIPS DOORS

The present invention relates to improvements in doors composed of multiple strips and more particularly to the fixing of the strips with respect to the cross bar from which they are suspended.

Certain of the strips of the doors in question may be deteriorated upon passage of handling vehicles or gear, and should be able to be replaced without having to dismantle all the strips. Due to the conventional constitution of these types of doors, it is generally not a rapid nor an easy operation to dismantle and re-assemble separate strips.

Furthermore, it is often required to remove all or part of the strips of a door when the weather is very hot, in order to improve ventilation of the premises closed by this door. This operation is difficult to carry out with the conventional assembly of the strips.

It is an object of the improvements forming the subject matter of the present invention to remedy these drawbacks and to enable a door composed of multiple strips to be produced of which each strip comprises means for dismantling it easily without this being prejudicial to its pivoting.

The invention will be more readily understood on reading the following description with reference to the accompanying drawings, in which.

Figure 1:
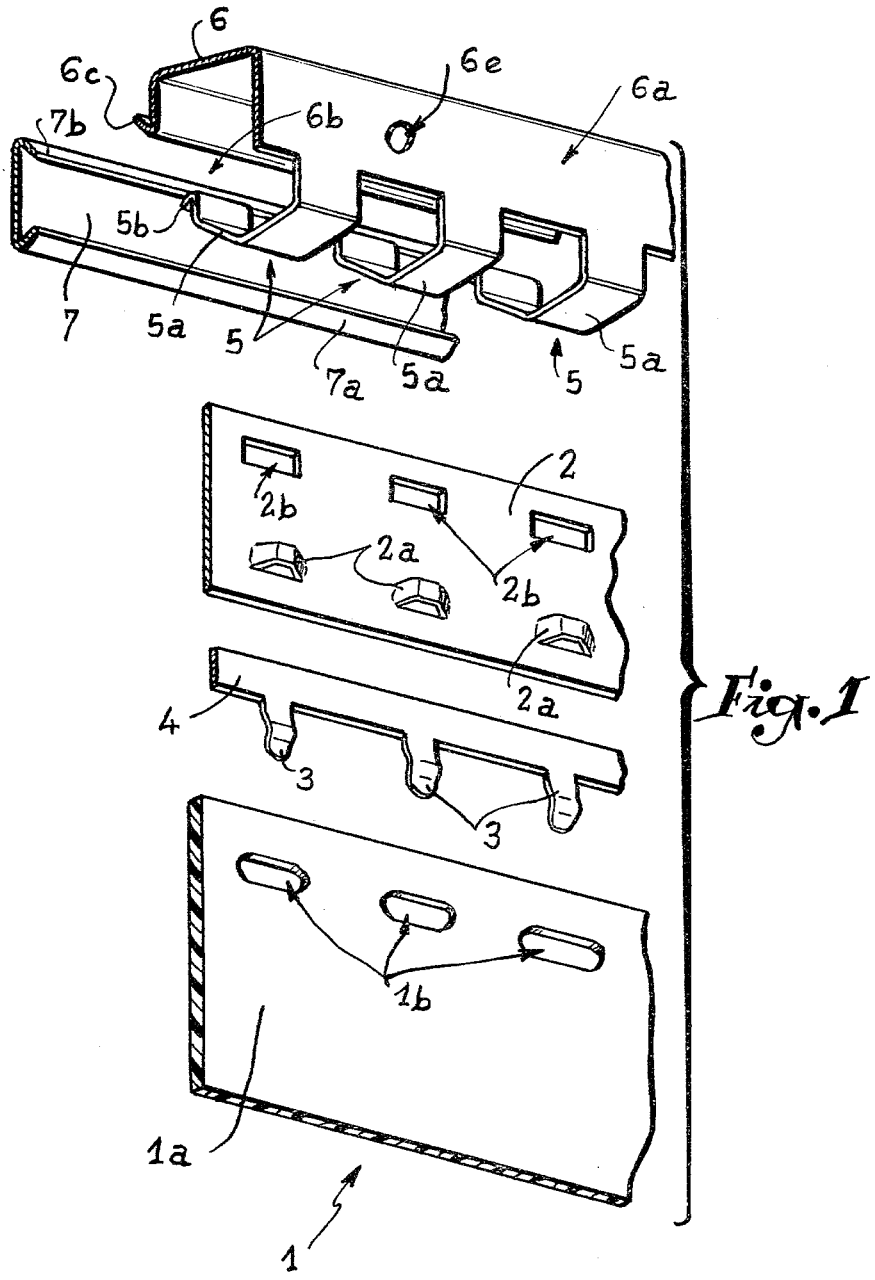
FIG. 1 is an exploded view in perspective of part of a door comprising the improvements according to the invention.

Referring now to the drawings, FIG. 1 shows the upper part 1*a* of one of the strips 1 of a door comprising the improvements according to the invention. This part of each strip is provided with perforations 1*b* disposed parallel to its upper edge.

To each strip 1 there corresponds a plate 2 provided with loops 2*a* which project outwardly perpendicularly from one of its vertical faces and whose shape is such that they may engage in the perforations 1*b* of the strip 1. The height of the loops is such that once the strip is applied against the face of the plate from which these loops extend, it is possible to engage a pin 3 therein. All the pins are connected by a bar 4 so as to constitute a sort of comb. It will be observed that the pins 3 are bent so that they have a certain elasticity allowing an excellent fastening of each strip 1 with respect to its plate 2 as they are tightened against each other.

Each of these plates 2 is provided with perforations 2*b* in which are engaged hooks 5 arranged in a channel 6 intended for supporting the strips whilst facilitating their pendular motion.

The transverse section of the channel 6 is generally in the form of an inverted C (FIG. 2) whose base is in the form of parallel hooks 5 which are spaced apart from one another by a sufficient distance for the plates 2 not to be too perforated in order to conserve a good mechanical strength. The origin of each hook forms part of the vertical face 6*a* of the channel whilst its useful part which engages in the corresponding perforation 2*b* of the plate 2 is deformed outwardly in order to constitute a leg 5*a* which is bent at an obtuse angle. The free end of each hook is folded so as to constitute an edge 5*b* divergent with respect to the opening 6*b* of the channel. The edge 6*c* of the latter which runs along said opening 6*b* is turned upwardly to constitute, with the edge 5*b* of each hook, a dovetail guide. Fixing holes 6*d*, 6*e* are provided, intended to enable the door according to the invention to be suspended below or on the side of the lintel of an opening or passageway.

Figure 2:
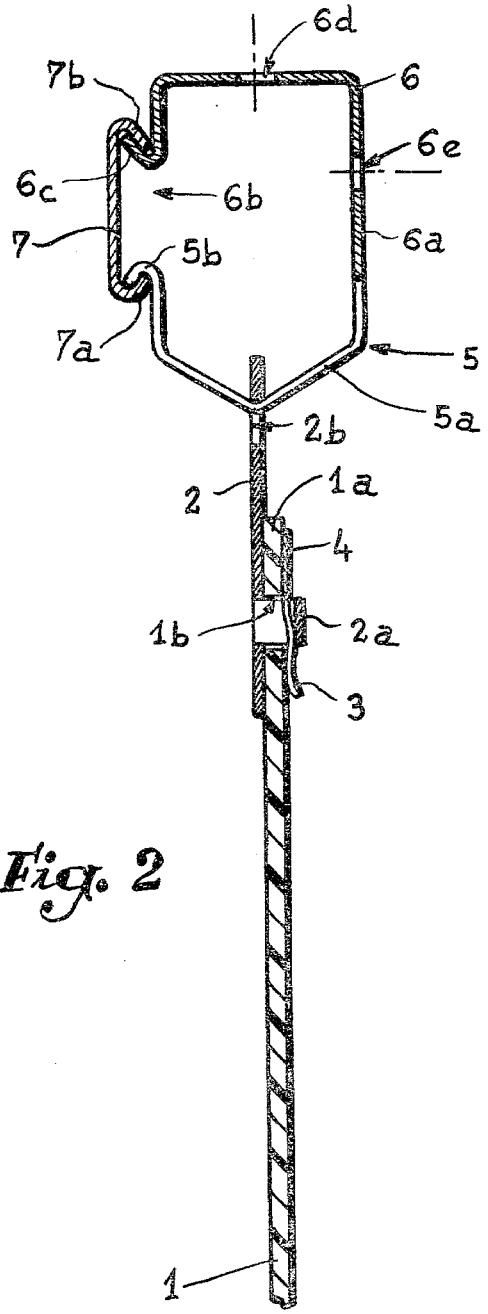
FIG. 2 is a transverse section through a door according to the invention, made at right angles through one of its strips.

As shown in FIG. 2, once the plates have been associated with the strips 1 due to the use of the bar 4, the hooks 5 are engaged in the perforations 2*b* of said plates with the result that the strips are suspended from the channel 6 so that they may easily make a pendular motion as the upper edge of each of these perforations 26 rests in the angle of the bent leg 5*a* of the corresponding hook 5.

To avoid the plates 2 being disengaged from the hooks 5 as a result of too great a displacement of certain strips 1, the guide constituted by the edges 5*b* of the hooks 5 and the edge 6*c* of the channel 6 are provided to cooperate with a panel 7 of which the longitudinal sides 7*a*, 7*b* are suitably folded down. This panel moves axially with respect to the guide to allow a plate 2 to be disengaged with a view for example to replacing a strip 1. It may be designed to fit by the elasticity of the elements.

A door is thus produced whose strips are rapidly and easily mounted on the suspension system which, furthermore, offers each strip an excellent amplitude whilst preventing it from becoming unhooked.

I claim:

1. A door of the type having multiple vertical strips with mounting plates at their upper ends provided with horizontally spaced perforations thereacross, and having support means with hooks mutually spaced horizontally therealong for engaging said perforations to support the strips, the support means comprising a horizontal longitudinally elongated channel having on one side a vertical face which supports said hooks in said mutually spaced relationship, the hooks extending transversely downwardly from said face and then upwardly across the channel and toward an opposite vertical face of the channel and terminating short of said opposite face to provide an opening between the free ends of the hooks and the opposed edge of the opposite face of the channel, the free ends of the hooks and the opposed edge being folded to diverge away from each other to provide a dovetail guide means; and an elongated panel having opposed longitudinal sides folded toward each other and disposed to engage said dovetail guide means and support the panel thereon for removably closing the opening between the hooks and said opposed edge.

* * * * *